US008380117B2

(12) United States Patent
Ohta

(10) Patent No.: US 8,380,117 B2
(45) Date of Patent: Feb. 19, 2013

(54) DEVELOPER STORAGE APPARATUS, DEVELOPER CARTRIDGE, DEVELOPING DEVICE AND IMAGE FORMING APPARATUS

(75) Inventor: Atsushi Ohta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 127 days.

(21) Appl. No.: 12/926,179

(22) Filed: Oct. 29, 2010

(65) Prior Publication Data

US 2011/0103857 A1 May 5, 2011

(30) Foreign Application Priority Data

Oct. 30, 2009 (JP) ..... 2009-249733

(51) Int. Cl.
*G03G 21/12* (2006.01)

(52) U.S. Cl. ..... 399/360

(58) Field of Classification Search ..... 399/61, 399/64, 358, 360, 366
See application file for complete search history.

(56) References Cited

U.S. PATENT DOCUMENTS

2009/0232548 A1* 9/2009 d'Entrecasteaux ..... 399/120
2010/0247119 A1* 9/2010 Kawahara ..... 399/35

FOREIGN PATENT DOCUMENTS

| | | |
|---|---|---|
| JP | 5-11610 | 1/1993 |
| JP | 11-161124 | 6/1999 |
| JP | 2000-181224 A | 6/2000 |
| JP | 2001-305846 | 11/2001 |
| JP | 2005-316351 A | 11/2005 |
| JP | 2006-98743 | 4/2006 |
| JP | 2006-113146 | 4/2006 |
| JP | 2009-128754 A | 6/2009 |

OTHER PUBLICATIONS

Machine translation of Ito (JP-2009-128754-A), publication date: Jun. 11, 2009.*

* cited by examiner

*Primary Examiner* — Walter L Lindsay, Jr.
*Assistant Examiner* — Frederick Wenderoth
(74) *Attorney, Agent, or Firm* — Rabin & Berdo, P.C.

(57) ABSTRACT

A developer storage apparatus includes a developer receiving opening for receiving a developer, a developer conveying unit disposed below the developer receiving opening and having a first conveying member that conveys the developer in a conveying direction, a developer detection unit for detecting the developer, and a wall surface portion provided on a downstream side of the developer detection unit in the conveying direction.

26 Claims, 14 Drawing Sheets

FIG.16A
FIG.16B
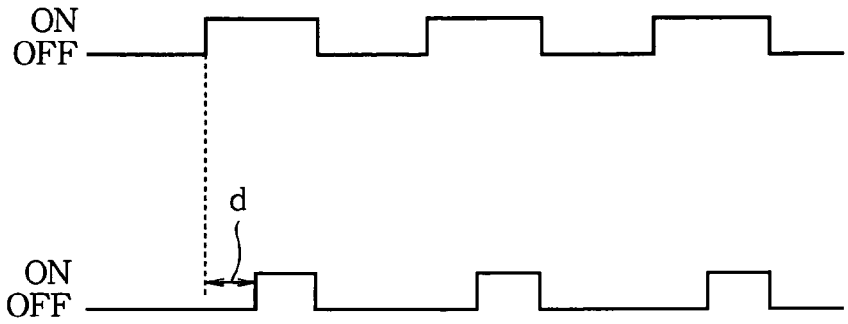
FIG.17
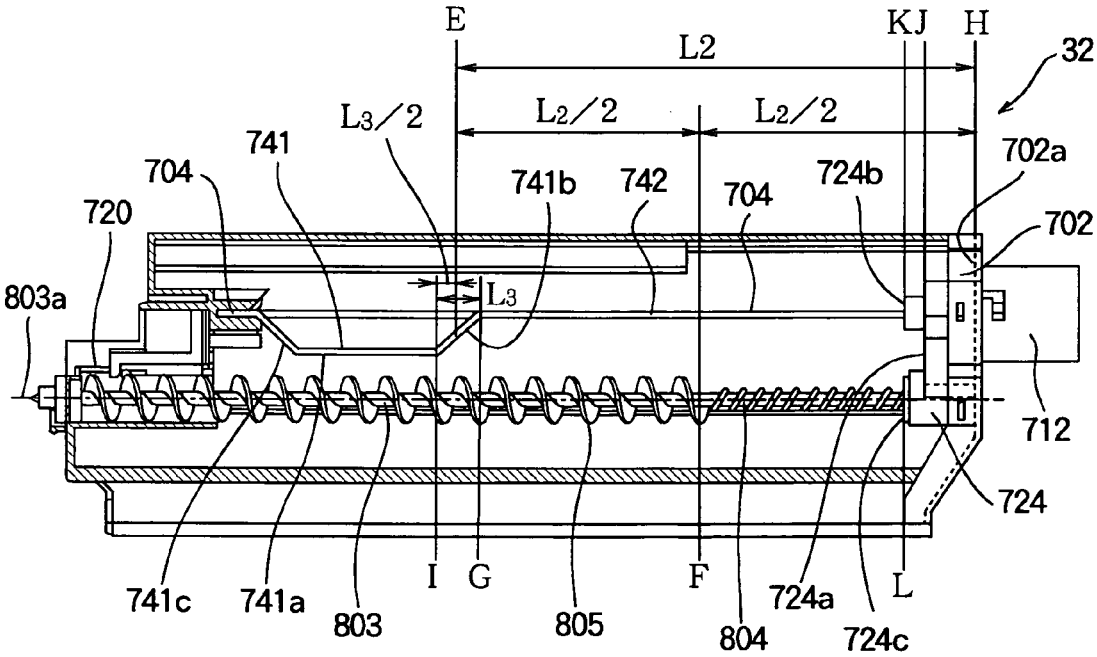

DEVELOPER STORAGE APPARATUS, DEVELOPER CARTRIDGE, DEVELOPING DEVICE AND IMAGE FORMING APPARATUS

BACKGROUND OF THE INVENTION

The present invention relates to a developer storage apparatus, a developer cartridge and a developing device employed in an image forming apparatus using electrophotographic process.

A conventional electrophotographic printer has a detachable toner cartridge for storing a toner. The toner cartridge supplies the toner to a developing unit. The developing unit develops a latent image formed on a surface of a photosensitive drum (i.e., an image bearing body) using the toner. The developed toner image is transferred to a printing medium by a transferring unit, and is fixed to a printing medium by a fixing unit. Then, the printing medium to which the toner image is fixed is ejected outside the printer.

After the toner image is transferred to the printing medium, a small amount of the toner may remain on the surface of the photosensitive drum. Such a residual toner is removed from the surface of the photosensitive drum by a cleaning unit. The removed toner (i.e., a waste toner) is collected in a waste toner collection chamber. Generally, the waste toner collection chamber is provided separately from a toner storage chamber that stores a fresh toner. For example, Japanese Laid-open Patent Publication No. 2000-181224 discloses a toner cartridge including a toner storage chamber that stores a fresh toner, and a waste toner collection chamber that stores the waste toner removed from the surface of the photosensitive drum.

The color electrophotographic printer has four developing units of four colors, and the developing units have respective toner cartridges. The above described waste toner collection chamber is provided in one of the four toner cartridges (for example, a black toner cartridge). The waste toners collected from the four developing units are stored in the waste toner collection chamber. With such a configuration, it is not necessary to provide a waste toner collection chamber in other three toner cartridges.

Recently, there is a need for a developer storage apparatus capable of efficiently storing a developer such as a waste toner.

SUMMARY OF THE INVENTION

The present invention is intended to provide a developer storage apparatus capable of efficiently storing a developer.

The present invention provides a developer storage apparatus including a developer receiving opening for receiving a developer, a developer conveying unit disposed below the developer receiving opening and configured to convey the developer in a conveying direction, a developer detection unit for detecting the developer, and a wall surface portion provided on a downstream side of the developer detection unit in the conveying direction.

With such a configuration, the developer is conveyed by the developer conveying unit in the conveying direction, and is pushed back by the wall surface portion. The developer detection unit can detect the developer which is pushed back from the wall surface portion. Thus, the developer detection unit detects the developer when the developer storage apparatus is almost filled with the developer. As a result, the developer storage apparatus can efficiently store the waste toner. Further, the increase in the conveying load and the leakage of the developer can be prevented.

The present invention also provides a developer storage apparatus including a developer receiving opening for receiving a developer, a developer conveying unit disposed below the developer receiving opening and configured to convey the developer in a conveying direction, a rotation unit juxtaposed to the developer conveying unit and having a crank portion, and a wall surface portion provided on a downstream side of the crank portion in the conveying direction.

The present invention also provides a developer cartridge including the above described developer storage apparatus.

The present invention also provides a developing device including the above described developer storage apparatus.

The present invention also provides a developing device including the above described developer cartridge.

The present invention also provides an image forming apparatus including the above described developer storage apparatus.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIGS. 16A and 16B are timing charts showing the detection operation according to the first embodiment of the present invention;

FIG. 17 is a sectional view showing an inner configuration of a waste toner storage portion according to the second embodiment of the present invention.

DETAILED DESCRIPTION OF THE PREFERRED EMBODIMENT

First Embodiment

Figure 1:
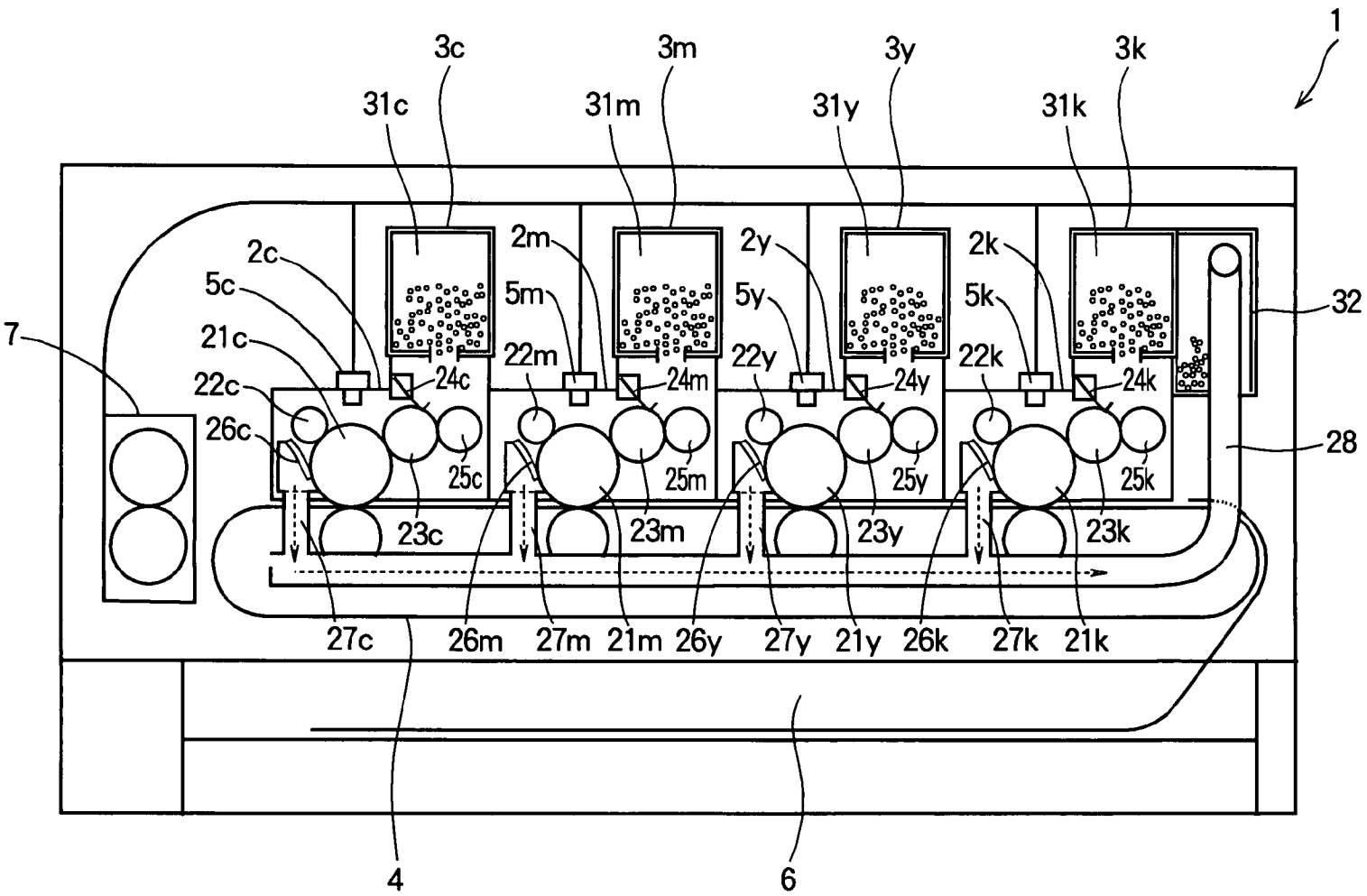
FIG. 1 is a side view schematically showing an electrophotographic printer according to the first embodiment of the present invention.

Hereinafter, the first embodiment of the present invention will be described. FIG. 1 is a side view schematically showing an electrophotographic printer 1 as an image forming apparatus according to the first embodiment of the present invention.

As shown in FIG. 1, the electrophotographic printer (hereinafter, referred to as a printer) 1 includes developing units 2*k*, 2*y*, 2*m* and 2*c* of black, yellow, magenta and cyan, and toner cartridges 3*k*, 3*y*, 3*m* and 3*c* that store toners (i.e., developers) of the respective colors. The printer 1 further includes a transfer unit 4, LED heads 5*k*, 5*y*, 5*m* and 5*c* as exposure units, and a fixing unit 7 that fixes the toner image to a printing medium such as a printing sheet. The printer 1 further includes a medium cassette 6 that stores printing media and feeds the printing media to the developing units 2*k*, 2*y*, 2*m* and 2*c*.

The developing units 2*k*, 2*y*, 2*m* and 2*c* (also referred to as process units) are arranged along a feeding path of the printing medium in this order in a direction from a supply side (i.e., left in FIG. 1) to an ejection side (i.e., right in FIG. 1). The developing units 2*k*, 2*y*, 2*m* and 2*c* constitute a developing device 2 (FIG. 2) detachably mounted to a main body of the printer 1. The toner cartridges 3*k*, 3*y*, 3*m* and 3*c* (i.e., developer cartridges) are disposed above the respective developing units 2*k*, 2*y*, 2*m* and 2*c*, and are detachably mounted to the developing units 2*k*, 2*y*, 2*m* and 2*c*.

The developing units 2*k*, 2*y*, 2*m* and 2*c* have the common configurations. That is, the developing units 2*k*, 2*y*, 2*m* and 2*c* respectively include photosensitive drums 21*k*, 21*y*, 21*m* and 21*c* as image bearing bodies, charging rollers 22*k*, 22*y*, 22*m* and 22*c* that charge the surfaces of the photosensitive drums 21*k*, 21*y*, 21*m* and 21*c*, and developing rollers 23*k*, 23*y*, 23*m* and 23*c* that develop latent images formed on the photosensitive drums 21*k*, 21*y*, 21*m* and 21*c* by the LED heads 5*k*, 5*y*, 5*m* and 5*c*. The developing units 2*k*, 2*y*, 2*m* and 2*c* further include developing blades 24*k*, 24*y*, 24*m* and 24*c* that form toner layers on the developing rollers 23*k*, 23*y*, 23*m* and 23*c*, and supplying rollers 25*k*, 25*y*, 25*m* and 25*c* that supply toners to the developing rollers 23*k*, 23*y*, 23*m* and 23*c*. The developing units 2*k*, 2*y*, 2*m* and 2*c* further include cleaning blades 26*k*, 26*y*, 26*m* and 26*c* that remove residual toners (which are not transferred to the printing medium) from the surfaces of the photosensitive drums 21*k*, 21*y*, 21*m* and 21*c*, and first conveying units 27*k*, 27*y*, 27*m* and 27*c* described later.

The developing units 2*k*, 2*y*, 2*m* and 2*c* constitute a developing device 2 (FIG. 2) as an integral replaceable unit. The developing device 2 has a second conveying unit 28.

The first conveying units 27*k*, 27*y*, 27*m* and 27*c* convey the waste toners (removed from the photosensitive drums 21*k*, 21*y*, 21*m* and 21*c* by the cleaning blades 26*k*, 26*y*, 26*m* and 26*c*) in the axial direction of the photosensitive drums 21*k*, 21*y*, 21*m* and 21*c*. The first conveying units 27*k*, 27*y*, 27*m* and 27*c* are constituted by, for example, conveying spirals. The second conveying unit 28 is configured to convey the waste toner conveyed by the first conveying units 27*k*, 27*y*, 27*m* and 27*c* to a waste toner storage portion 32 disposed on the upstream end of the developing units 2*k*, 2*y*, 2*m* and 2*c*. The waste toner storage portion 32 (i.e., a developer storage apparatus) stores the waste toner conveyed by the second conveying unit 28.

The toner cartridges 3*k*, 3*y*, 3*m* and 3*c* (i.e., developer cartridges) include toner storage portions (i.e., developer storage portions) 31*k*, 31*y*, 31*m* and 31*c* for storing fresh (unused) toners. The developing device 2 and the toner cartridges 3*k*, 3*y*, 3*m* and 3*c* are respectably replaceable. In other words, the developing device 2 and the toner cartridges 3*k*, 3*y*, 3*m* and 3*c* can be replaced with new ones, when the toners are used up or when lifetimes of components thereof expire.

Figure 2:
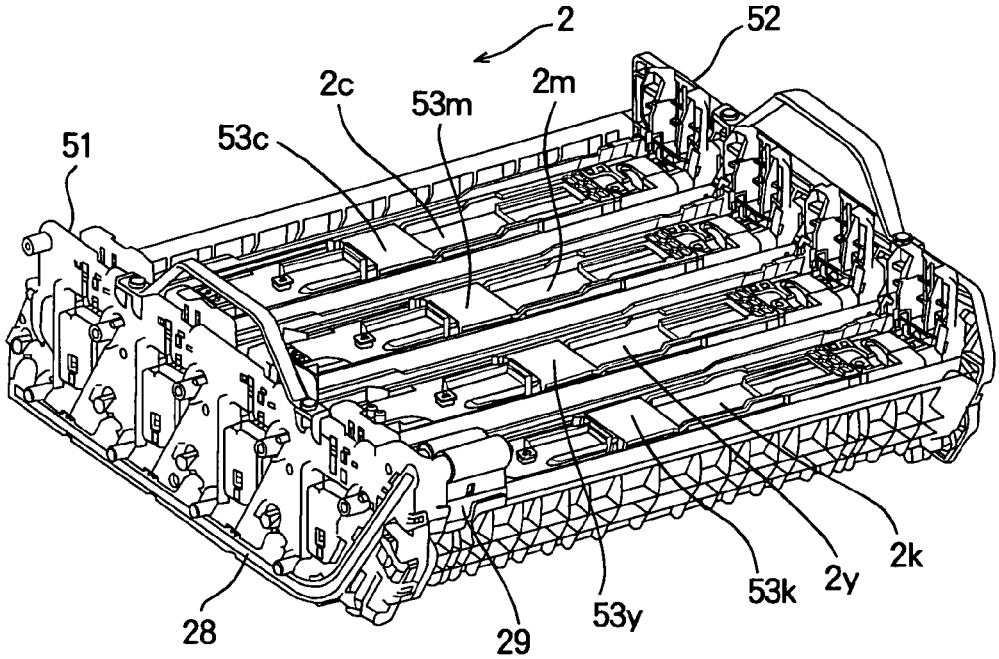
FIG. 2 is a perspective view showing a developing device without toner cartridges according to the first embodiment of the present invention.
Figure 3:
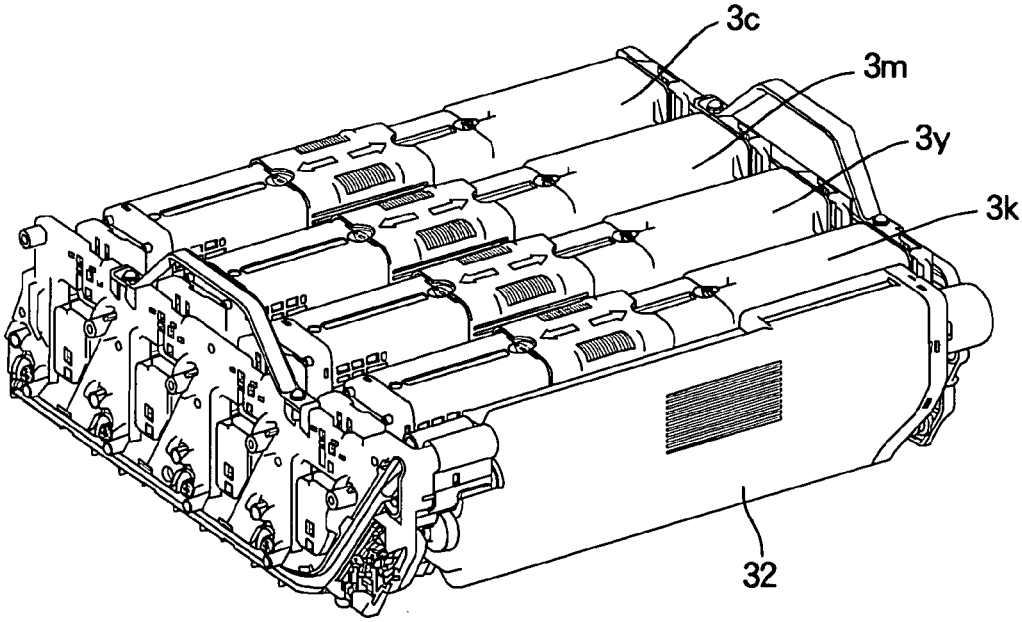
FIG. 3 is a perspective view showing the developing device with toner cartridges according to the first embodiment of the present invention.
Figure 4:
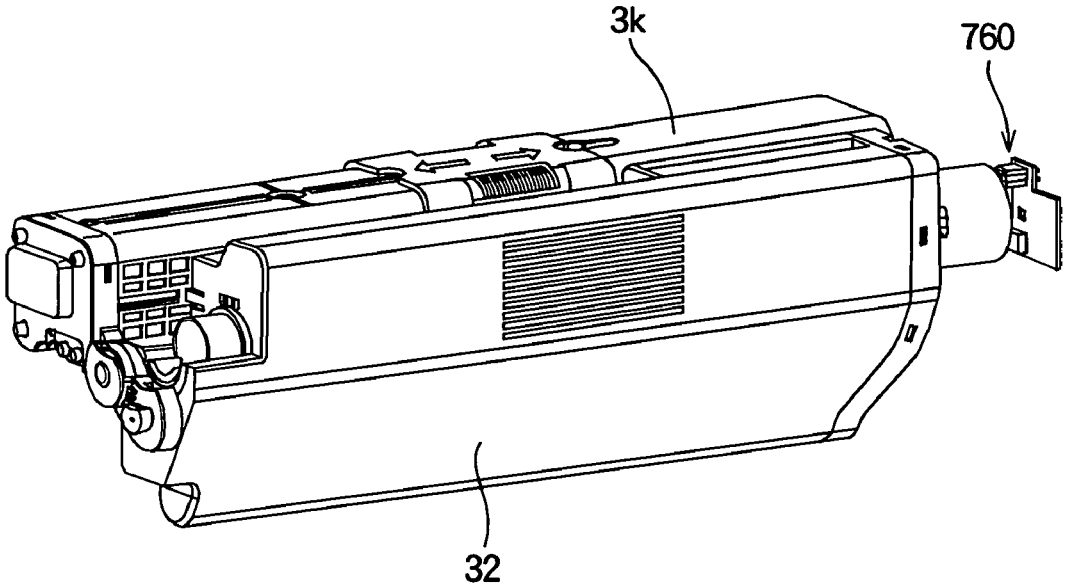
FIG. 4 is a perspective view showing a black toner cartridge according to the first embodiment of the present invention.

FIG. 2 is a perspective view showing the developing device 2 according to the first embodiment of the present invention. FIG. 3 is a perspective view showing the developing device 2 to which the toner cartridges 3*k*, 3*y*, 3*m* and 3*c* are mounted according to the first embodiment of the present invention. FIG. 4 is a perspective view showing the black toner cartridge 3*k* according to the first embodiment of the present invention.

As shown in FIG. 2, the developing units 2*k*, 2*y*, 2*m* and 2*c* are disposed at equal intervals, and held by a first side frame body 51 and a second side frame body 52 disposed on both sides of the developing units 2*k*, 2*y*, 2*m* and 2*c*. The first and second side frame bodies 51 and 52 have high rigidity. The developing units 2*k*, 2*y*, 2*m* and 2*c* and the first and second side frame bodies 51 and 52 constitute an integral structure, i.e., the developing device 2. The developing units 2*k*, 2*y*, 2*m* and 2*c* have toner receiving openings (not shown) for receiving toners from the toner cartridges 3*k*, 3*y*, 3*m* and 3*c* (FIG. 3). The toner receiving openings are shut by receiving opening shutter members 53*k*, 53*y*, 53*m* and 53*c*.

The first side frame body 51 has the second conveying unit 28 connected to the first conveying units 27*k*, 27*y*, 27*m* and 27*c* (FIG. 1) of the developing units 2*k*, 2*y*, 2*m* and 2*c*. The second conveying unit 28 collectively conveys the waste toner (ejected via the first conveying units 27*k*, 27*y*, 27*m* and 27*c*) to the waste toner storage portion 32 as described later. A waste toner ejection portion 29 is provided on an end of the second conveying unit 28. The waste toner ejection portion 29 is connected to the waste toner receiving opening 720 (FIG. 5) described later.

As shown in FIG. 3, in a state where the toner cartridges 3*k*, 3*y*, 3*m* and 3*c* are mounted to the developing device 2, the waste toner receiving opening 720 (FIG. 5) of the waste toner storage portion 32 (i.e., the developer storage apparatus) is connected to the waste toner ejection portion 29. Further, as shown in FIG. 4, the waste toner storage portion 32 is integrated with the toner storage portion 31K of the black toner cartridge 3*k*. Generally, consumption of the black toner is the largest among four colors. Therefore, replacement frequency of the black toner cartridge 3*k* is higher than the replacement frequency of the yellow, magenta and cyan toner cartridges 3*y*, 3*m* and 3*c*. For this reason, the waste toner storage portion 32 is integrated into the black toner cartridge 3*k* so that the black toner cartridge 3*k* can be replaced before the waste toner storage portion 32 becomes full. It is alternatively possible that the waste toner storage portion 32 is integrated into the toner cartridge 3*y*, 3*m* or 3*c*. Further, the waste toner storage portion 32 can be provided separately from the toner cartridges 3*k*, 3*y*, 3*m* and 3*c*, so as to be detachably mounted to the developing device 2 independently from the toner cartridges 3*k*, 3*y*, 3*m* and 3*c*.

Figure 5:
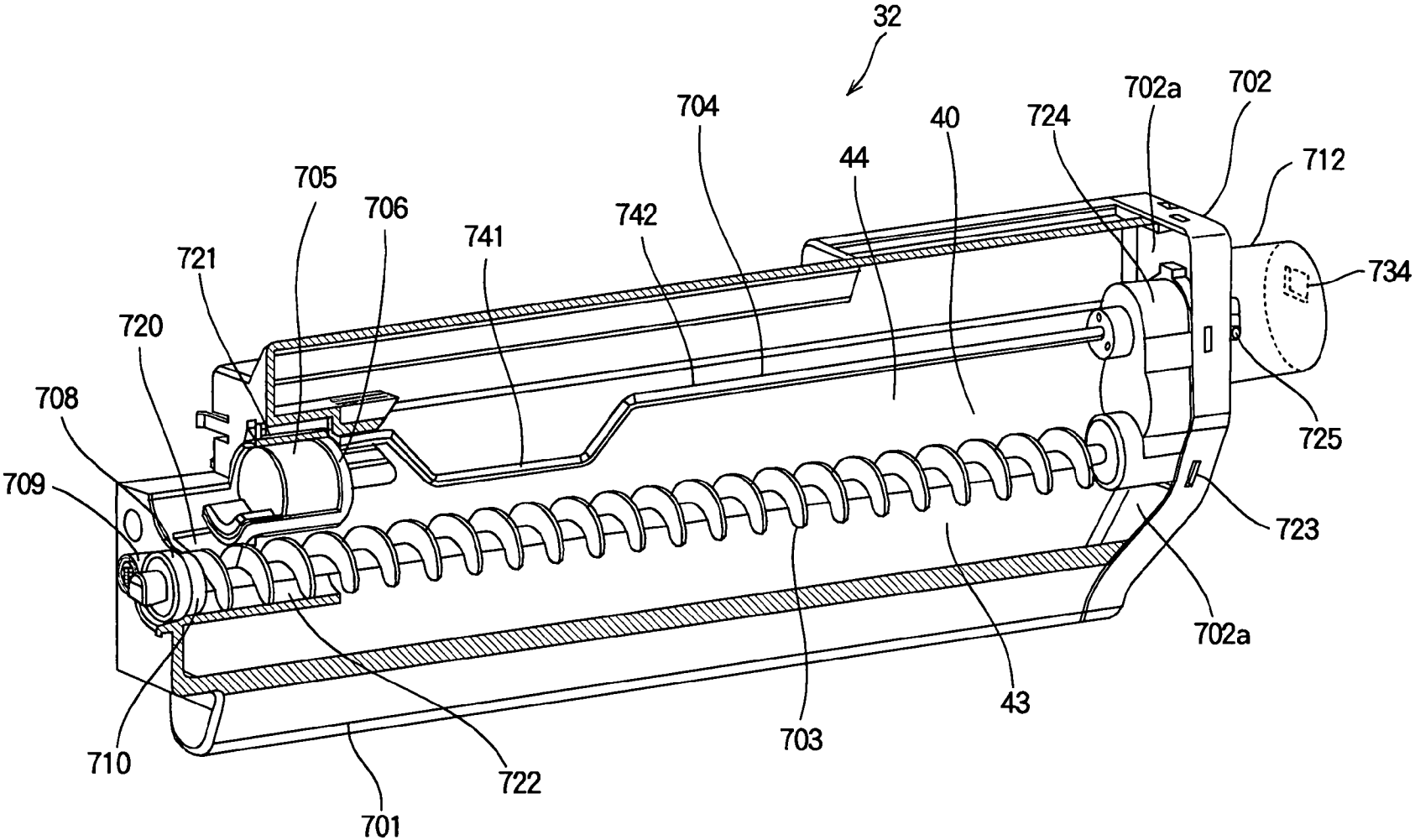
FIG. 5 is a partially cutaway perspective view showing an inner configuration of a waste toner storage portion according to the first embodiment of the present invention.
Figure 6:
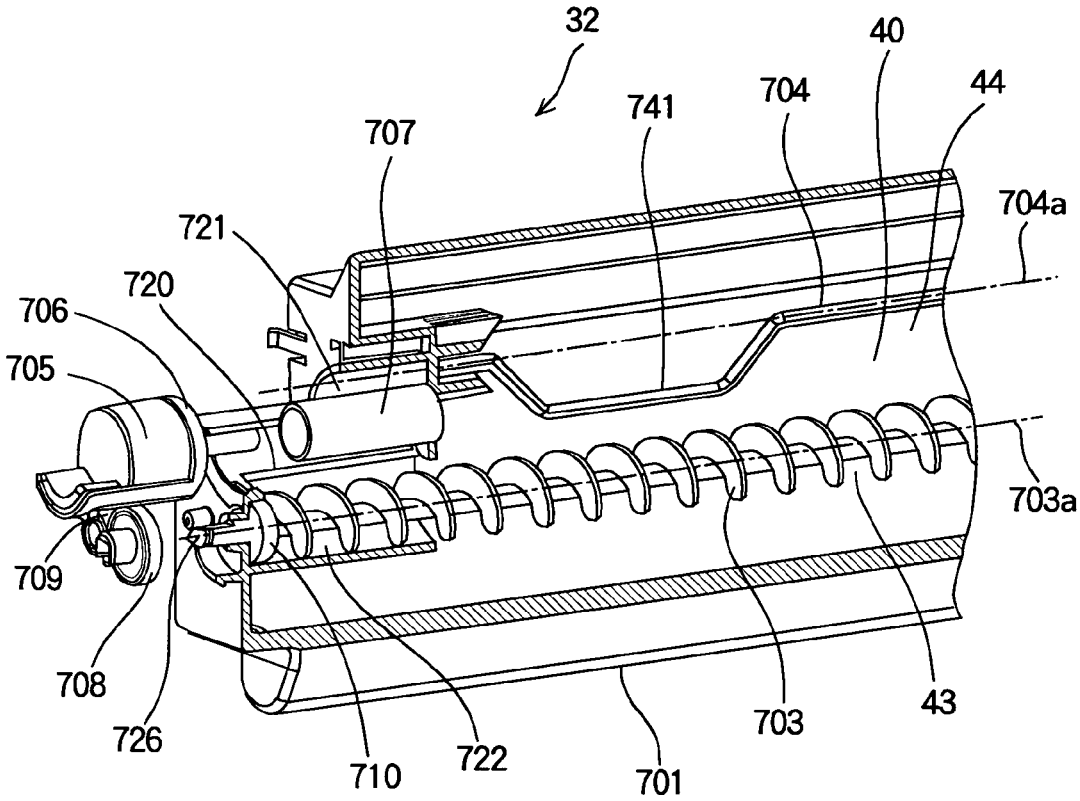
FIG. 6 is a partially cutaway perspective view showing a waste toner receiving opening of the waste toner storage portion and its surroundings according to the first embodiment of the present invention.
Figure 7:
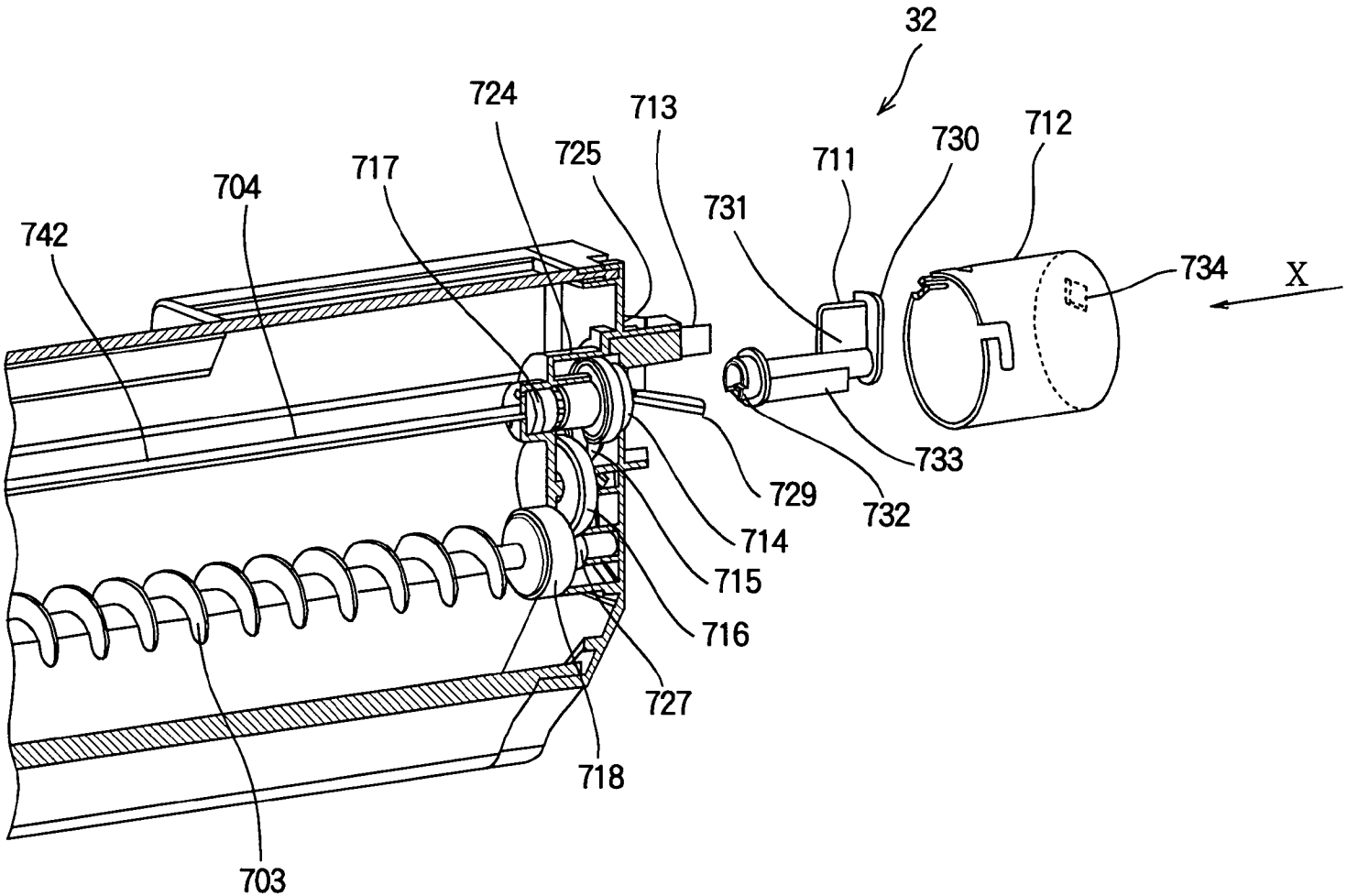
FIG. 7 is a partially cutaway perspective view showing a driving unit of a waste toner full detection bar of the waste toner storage portion according to the first embodiment of the present invention.

FIG. 5 is a partially cutaway perspective view showing an inner configuration of the waste toner storage portion 32 according to the first embodiment of the present invention. FIG. 6 is a partially cutaway perspective view showing the waste toner receiving opening 720 of the waste toner storage portion 32 and its surroundings. FIG. 7 is a partially cutaway perspective view showing a driving unit of the waste toner full detection bar 704 of the waste toner storage portion 32 according to the first embodiment of the present invention.

As shown in FIG. 5, the waste toner storage portion as the developer storage apparatus includes an outer frame 701 and a side plate 702 that constitute a waste toner storage space 40 for storing the waste toner. The waste toner receiving opening 720 (i.e., a developer receiving opening) is disposed substantially at an end of the waste toner storage portion 32. A waste toner conveying spiral 703 (i.e., a developer conveying unit) is provided in the waste toner storage portion 32, and is disposed below the waste toner receiving opening 720. The waste toner conveying spiral 703 is driven to rotate about a rotation axis 703 to convey the waste toner in a conveying direction from the end of the waste toner storage portion 32 (i.e., the waste toner receiving opening 720 side) toward an opposite end of the waste toner storage portion 32. A waste toner full detection bar 704 (i.e., a rotation member) is rotatably provided in the waste toner storage portion 32. The waste toner full detection bar 704 is juxtaposed to the waste toner conveying spiral 703. More specifically, the waste toner full detection bar 704 is disposed above the waste toner conveying spiral 703 so as to be substantially parallel to the rotation axis 703*a* of the waste toner conveying spiral 703. The waste toner full detection bar 704 has a crank portion 741 described later. The waste toner storage space 40 includes a first conveying space 43 where the waste toner conveying spiral 703 conveys the waste toner, and a second conveying space 44 where the waste toner full detection bar 704 is provided.

The outer frame 701 has craws 723 that engage a side plate 702. The side plate 702 has a wall surface (i.e., a wall surface potion) 702*a* that constitutes a part of the waste toner storage space 40. The wall surface 702*a* is disposed on an end of the waste toner storage portion 32 opposite to the waste toner receiving opening 720. Further, the wall surface 702*a* is at a predetermined distance from the crank portion 741 on the downstream side in the conveying direction of the waste toner by the waste toner conveying spiral 703.

As shown in FIGS. 5 and 6, the waste toner storage portion 32 (i.e., the developer storage apparatus) has a receiving opening shutter member 705 in the vicinity of a portion where the waste toner starts to be conveyed by the waste toner conveying spiral 703. A shutter seal member 706 is provided on a shaft of the receiving opening shutter member 705. The waste toner storage portion 32 further includes a shutter biasing spring 707 that biases the receiving opening shutter member 705, spiral driving gears 708 and 709 for driving the waste toner conveying spiral 703, and a spiral shaft seal member 710 provided on the shaft of the waste toner conveying spiral 703.

Further, as shown in FIG. 7, the waste toner storage portion 32 includes a waste toner full detector member 711, a detector cover 712 covering the waste toner full detector member 711, a chattering prevention film 713, a driving gear 714, reduction gears 715 and 716, a detection bar seal member 717 provided on the shaft of the waste toner full detection bar 704, and a spiral shaft seal member 718 provided on the shaft of the waste toner conveying spiral 703.

As shown in FIGS. 5 and 6, the outer frame 701 has the waste toner receiving opening 720 connected to the waste toner ejection portion 29 (FIG. 2) for receiving the waste toner, and a shutter mounting portion 721 to which the receiving opening shutter member 705 is slidably mounted. Further, the outer frame 701 has a cylindrical conveying path 722 disposed below the waste toner conveying spiral 703 for causing the waste toner (falling from the waste toner receiving opening 720) to move horizontally.

As shown in FIGS. 5 and 7, the side plate 702 has a gear housing portion 724 housing the driving gear 714 and the reduction gears 715 and 716, and a detector cover mounting portion 725 to which the detector cover 712 is mounted.

As shown in FIG. 6, a gear engagement portion 726 is formed on the waste toner receiving opening 720 side of the waste toner conveying spiral 703. The gear engagement portion 726 engages the spiral driving gear 708. A rotation of a not shown driving source is transmitted to the waste toner conveying spiral 703 via the spiral driving gears 708 and 709 and the gear engagement portion 726, so that the waste toner conveying spiral 703 rotates. As shown in FIG. 7, a gear portion 727 is provided on the side plate 702 side of the waste toner conveying spiral 703. The gear portion 727 transmits the rotation of the waste toner conveying spiral 703 to the reduction gears 716 and 715 for rotating the waste toner full detection bar 704. The waste toner full detection bar 704 has the crank portion 741 (i.e., a developer detection unit) for physically detecting the accumulation of the waste toner based on a resistance thereof, and a straight portion 742 juxtaposed to (more specifically, extending substantially parallel to) the rotation axis 703*a* of the waste toner conveying spiral 703.

The crank portion 741 is disposed on the waste toner receiving opening 720 side, i.e., where a movement of the waste toner in the second conveying space 44 is terminated. The straight portion 742 is provided on a part of the waste toner full detection bar 704 other than the crank portion 741. The crank portion 741 has a shorter length than the waste toner conveying spiral 703 in a longitudinal direction of the waste toner storage portion 32. In the conveying direction of the waste toner conveying spiral 703, the crank portion 741 is disposed on a downstream side with respect to the waste toner receiving opening 720, and on an upstream side with respect to the wall surface 702*a*. The crank portion 741 has a trapezoidal shape with inclined portions in order to facilitate machining. However, it is also that the crank portion 741 has a right-angle rectangular shape with no inclined portion. The rotation axis 703*a* (FIG. 6) of the waste toner conveying spiral 703 is substantially parallel to the rotation axis 704*a* of the waste toner full detection bar 704.

The waste toner full detector member 711 has a light reflection surface 730 that reflects a light from a reflection-type sensor 760 (FIG. 4) provided on a main body of the developing device 2. The detector cover 712 (covering the waste toner full detector member 711) has a substantially cylindrical shape, and has an opening 734 for transmitting the light from the reflection-type sensor 760 to reach the light reflection surface 730. The waste toner full detector member 711 has a rib 731 that engages the chattering prevention film 713.

The reflection-type sensor 760 (i.e., an optical detection unit or a rotation detection unit) shown in FIG. 4 has a light emitting portion and a light receiving portion. The reflection-type sensor 760 drives the light emitting portion to emit a light. If the light receiving portion receives the reflected light (reflected at the light reflection surface 730), the reflection-type sensor 760 is turned to the ON-state. If the light receiving portion does not receive the reflected light, the reflection-type sensor 760 is in the OFF-state.

Figure 8A:
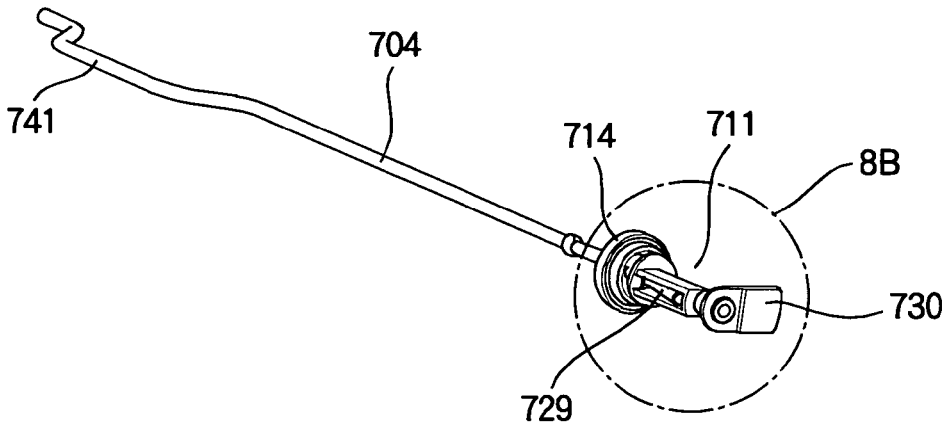
FIG. 8A is a perspective view showing the waste toner full detection bar, a driving gear and a waste, toner full detector member according to the first embodiment of the present invention.
Figure 8B:
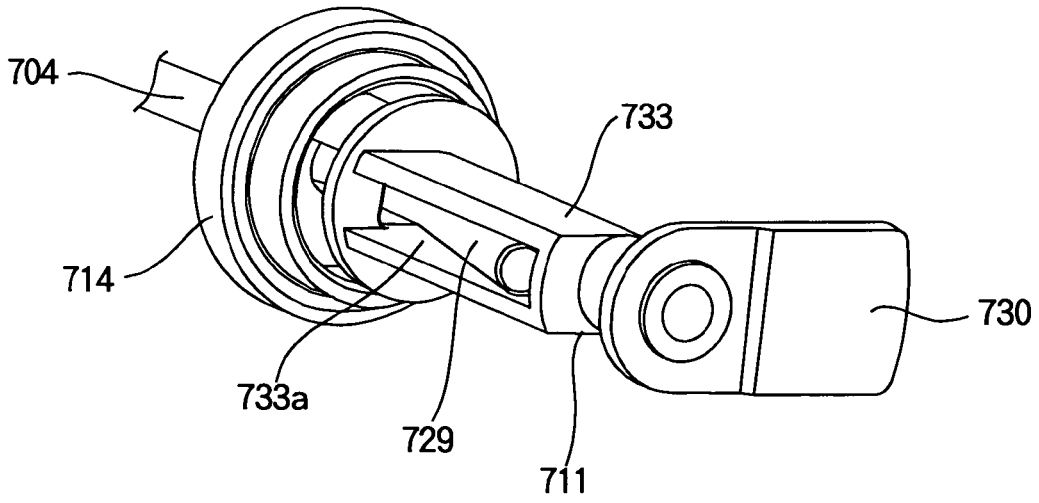
FIG. 8B is an enlarged perspective view showing a part encircled by a circle 8B in FIG. 8A.
Figure 9A:
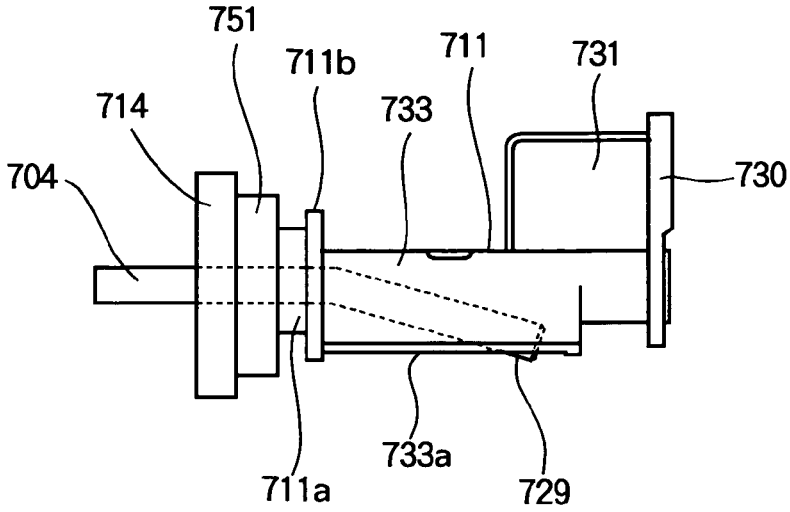
FIGS. 9A and 9B are a front view and an exploded perspective view showing the waste toner full detector member, the driving gear and the waste toner full detection bar according to the first embodiment of the present invention.
Figure 9B:
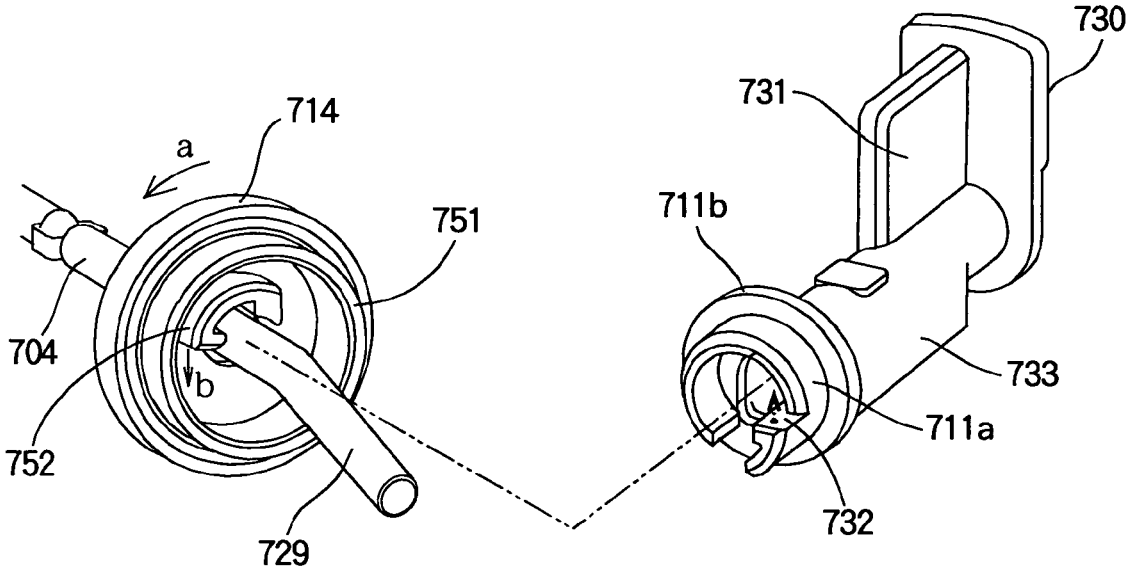

FIG. 8A is a perspective view showing the waste toner full detection bar 704, the driving gear 714 and the waste toner full detector member 711. FIG. 8B is an enlarged view showing a part encircled by a circle indicated by a mark "8B" in FIG. 8A. FIGS. 9A and 9B are a front view and an exploded perspective view showing the waste toner full detection bar 704, the driving gear 714 and the waste toner full detector member 711.

As shown in FIGS. 8A and 8B, the waste toner full detection bar 704 penetrates the driving gear 714, and an end portion of the waste toner full detection bar 704 is bent at a predetermined angle with respect to the rotation axis of the waste toner full detection bar 704. The end portion of the waste toner full detection bar 704 forms a hook portion 729. Further, the waste toner full detector member 711 has a hook engagement portion 733 having a concave 733*a* that engages the hook portion 729 of the waste toner full detection bar 704. By the engagement between the hook portion 729 and the hook engagement portion 733, the waste toner full detector member 711 rotates together with the waste toner full detection bar 704.

As shown in FIGS. 9A and 9B, a ring-shaped portion 751 is formed coaxially and integrally with the driving gear 714. A rotation transmission rib 752 is integrally formed with the driving gear 714, and is disposed inside the ring-shaped portion 751. The waste toner full detector member 711 has a cylindrical portion 711*a* that slidably engages an inner surface of the ring-shaped portion 751, and a flange portion 711*b* that abuts against an end of the ring-shaped portion 751. The cylindrical portion 711*a* has a rotation transmission rib 732 that abuts against the rotation transmission rib 752 when the rotation transmission rib 752 rotates in a direction shown by an arrow "b" in FIG. 9B (i.e., when the driving gear 714 rotates in a direction shown by an arrow "a").

FIGS. 10A through 10D are schematic views showing the rotation of the waste toner full detection bar 704, the driving gear 714 and the waste toner full detector member 711, as seen in a direction shown by an arrow X in FIG. 7.

Figure 10A:
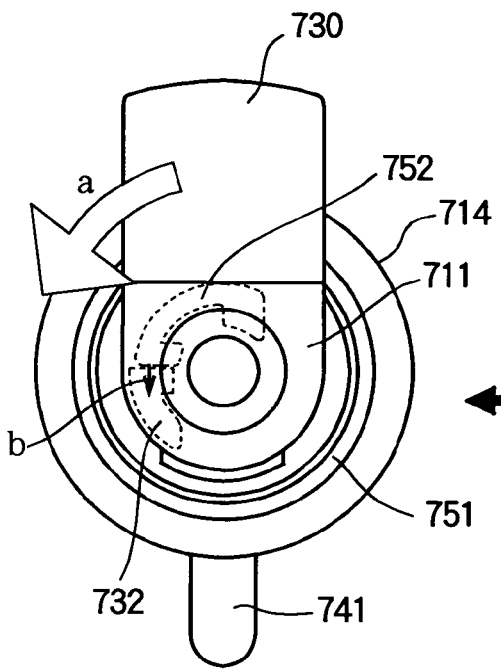
FIGS. 10A, 10B, 10C and 10D are schematic views showing an operation of the waste toner full detection bar, the driving gear and the waste toner full detector member according to the first embodiment of the present invention.
Figure 10D:
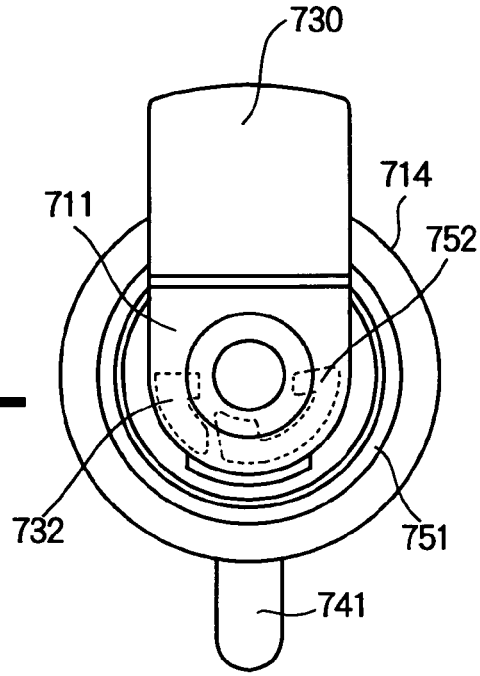
Figure 10B:
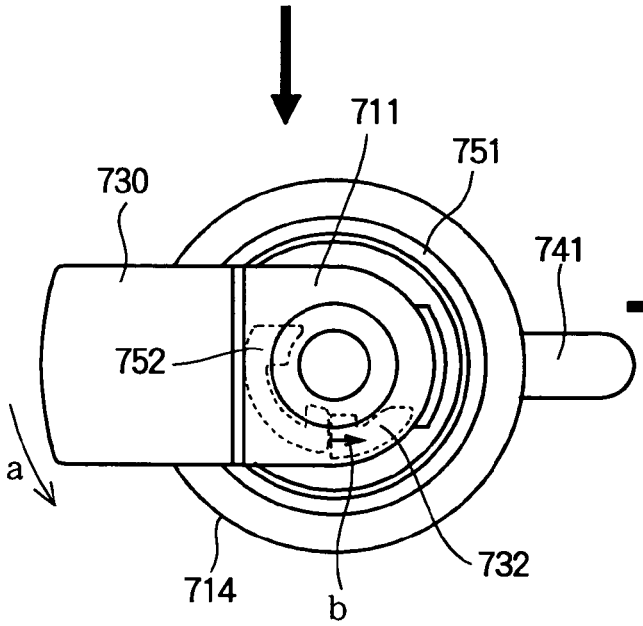
Figure 10C:
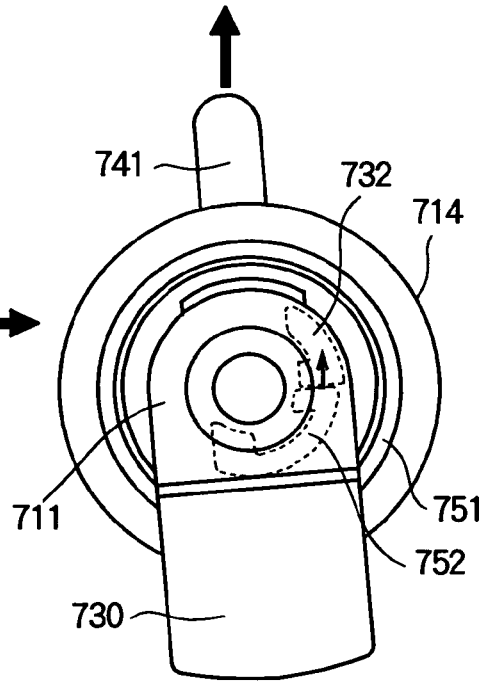

As shown in FIGS. 10A and 10B, when the driving gear 714 rotates in a direction shown by an arrow "a" (i.e., counterclockwise), the rotation transmission rib 752 contacts and pushes the rotation transmission rib 732 in a direction shown by the arrow "b", and the rotation of the driving gear 714 is transmitted to the waste toner full detector member 711. Further, the rotation of the waste toner full detector member 711 is transmitted to the waste toner full detection bar 704 (omitted in FIGS. 10A through 10D) by the engagement between the hook portion 729 and the hook engagement portion 733 (see, FIG. 8B). Therefore, the waste toner full detection bar 704 and the waste toner full detector member 711 rotate together with the driving gear 714.

As shown in FIG. 100, when the crank portion 741 of the waste toner full detection bar 704 reaches the top position, the waste toner full detection bar 704 (together with the waste toner full detector member 711) starts rotating by gravity due to the weight of the crank portion 741, until the crank portion 741 reaches the bottom position as shown in FIG. 10D. In this process, the rotation transmission rib 732 separates from the rotation transmission rib 752. The crank portion 741 stays at the bottom position (FIG. 10D) until the rotation transmission rib 752 comes to engagement with the rotation transmission rib 732 (by the rotation of the driving gear 714) as shown in FIG. 10A, and thereafter the waste toner full detection bar 704 and the waste toner full detector member 711 start rotating together with the driving gear 714.

Next, an operation of the printer 1 according to the first embodiment will be described.

Figure 11:
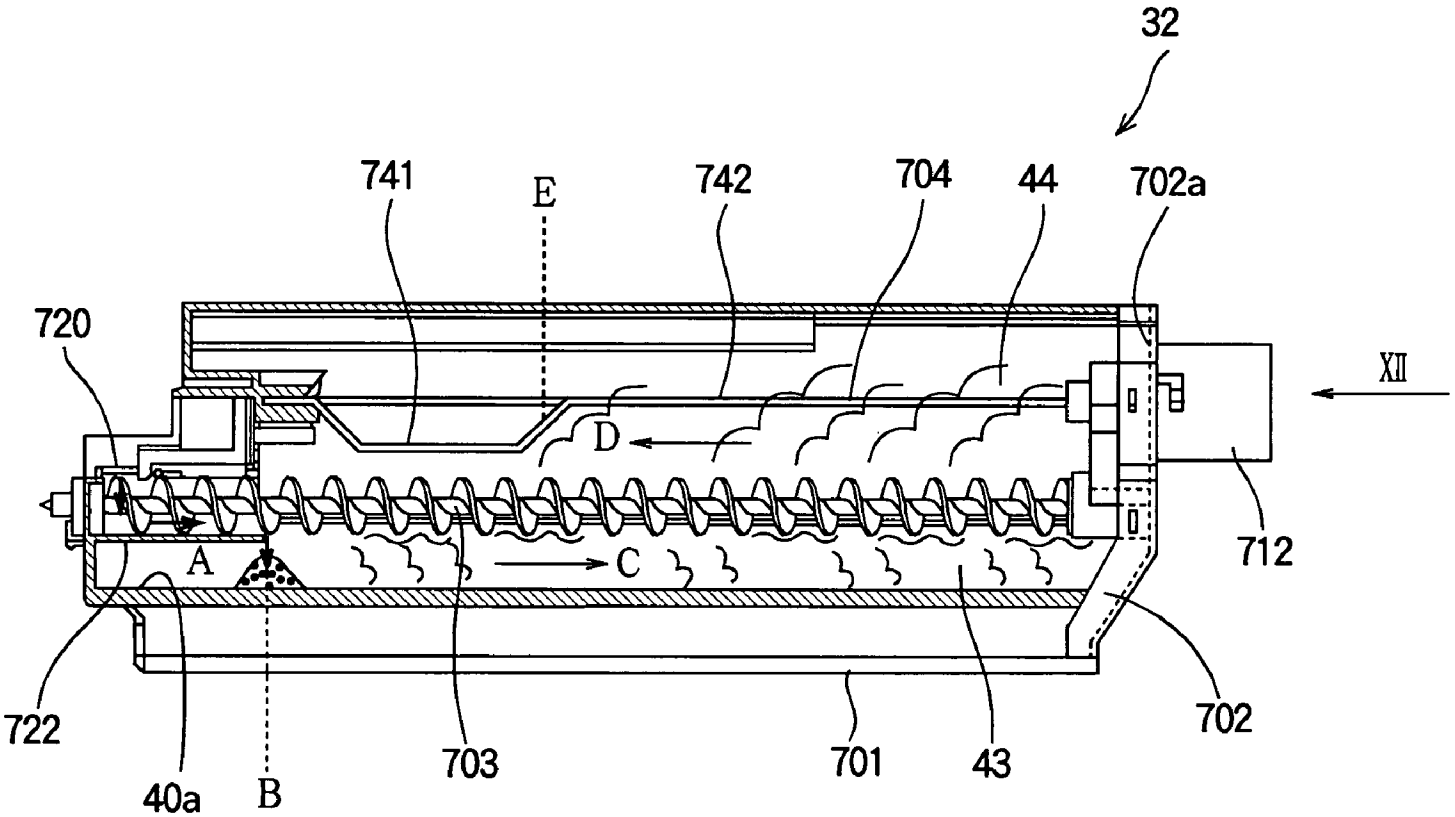
FIG. 11 is a sectional view showing a conveying operation of a waste toner in the waste toner storage portion according to the first embodiment of the present invention.

FIG. 11 shows an operation for conveying the waste toner in the waste toner storage portion 32 according to the first embodiment. As shown in FIG. 11, the waste toner is ejected from the developing units 2*k*, 2*y*, 2*m* and 2*c* (FIG. 2), is conveyed by the second conveying unit 28 (FIG. 2), and is stored in the waste toner storage portion 32 via the waste toner receiving opening 720. The waste toner conveying spiral 703 rotates to convey the waste toner through the cylindrical conveying path 722 in a direction indicated by an arrow A. As the waste toner reaches the end of the cylindrical conveying path 722, the waste toner starts to be accumulated in a chevron shape at a position B on a bottom surface 40*a* of the waste toner storage space 40. When the accumulated waste toner reaches the height of the waste toner conveying spiral 703, the waste toner is conveyed in a direction indicated by an arrow C by the waste toner conveying spiral 703. Similarly, the waste toner accumulated at a portion on a downstream side of the position B (in the direction indicated by the arrow C) is also conveyed in the direction indicated by the arrow C by the waste toner conveying spiral 703. As a result, the waste toner is accumulated in the first conveying space 43, and reaches the wall surface 702*a* of the side plate 702.

After the accumulated waste toner reaches the wall surface 702*a* of the side plate 702, the waste toner is accumulated in a chevron shape whose height exceeds the height of the waste toner conveying spiral 703. Then, the waste toner starts to be accumulated in the second conveying space 44 in a direction indicated by an arrow D which is different from (more specifically, opposite to) the conveying direction indicated by the arrow C.

In this state, the straight portion 742 of the waste toner full detection bar 704 is buried in the waste toner. When the accumulated waste toner reaches a position "E" defined on the inclined portion of the crank portion 741 of the waste toner full detection bar 704, a rotational motion of the waste toner full detection bar 704 changes due to a resistance of the accumulated waste toner acting on the crank portion 741. The change in the rotational motion of the waste toner full detection bar 704 is detected as described later (with reference to FIGS. 12 through 15). The crank portion 741 is disposed at a portion where the conveying of the waste toner in the second conveying space 44 is terminated.

The rotation of the waste toner conveying spiral 703 is transmitted to the driving gear 714 via the gear portion 727 (FIG. 7) and the reduction gears 716 and 715. As described with reference to FIGS. 10A through 10D, the rotation of the driving gear 714 is transmitted to the waste toner full detector member 711 (by the engagement between the rotation transmission ribs 732 and 752), and is further transmitted to the waste toner full detection bar 704 by the engagement between the hook engagement portion 733 and the hook portion 729 (FIG. 8B).

FIGS. 12 through 15 show a detection operation of the accumulation of the waste toner according to the first embodiment. FIGS. 12 through 15 show the waste toner full detection bar 704 and the waste toner full detector member 711 as seen in a direction indicated by an arrow XII in FIG. 11.

Figure 12:
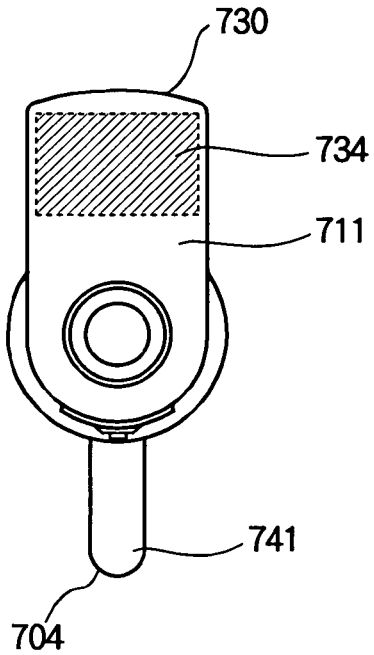
FIG. 12 is a first view for illustrating a detection operation according to the first embodiment of the present invention.

First, when the crank portion 741 of the waste toner full detection bar 704 is in the bottom position as shown in FIG. 12, the light reflection surface 730 of the waste toner full detector member 711 is in the top position. In this state, the light reflection surface 730 faces the opening 734 (shown by hatching) of the detector cover 712 (FIG. 7), and reflects light from the refection-type sensor 760 (FIG. 4). The reflection-type sensor 760 detects the light reflected by the light reflection surface 730, and turns to the ON-state.

Figure 13:
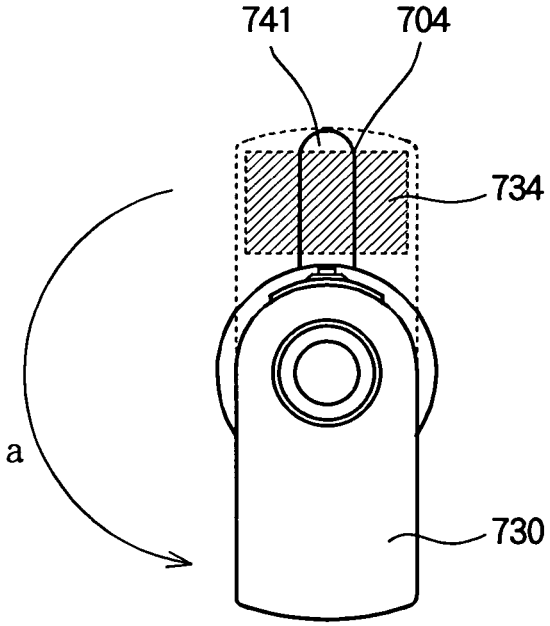
FIG. 13 is a second view for illustrating the detection operation according to the first embodiment of the present invention.

As described above, the rotation of the driving gear 714 is transmitted to the waste toner full detection bar 704 and the waste toner full detector member 711, so that the waste toner full detection bar 704 and the waste toner full detector member 711 rotate counterclockwise (shown by an arrow "a") together with each other as shown in FIGS. 12 and 13. In this state, the light reflection surface 730 moves out of a position facing the opening 734 of the detector cover 712, and therefore the reflection-type sensor 760 (FIG. 4) is turns to the OFF-state. Thereafter, the crank portion 741 of the waste toner full detection bar 704 reaches the top position shown in FIG. 13.

When the crank portion 741 of the waste toner full detection bar 704 slightly rotates counterclockwise from the top position as shown in FIG. 13, the engagement between the rotation transmission ribs 732 and 752 (FIG. 9B) is released, and the waste toner full detection bar 704 rotates counterclockwise (shown by the arrow "a") by gravity.

Figure 14:
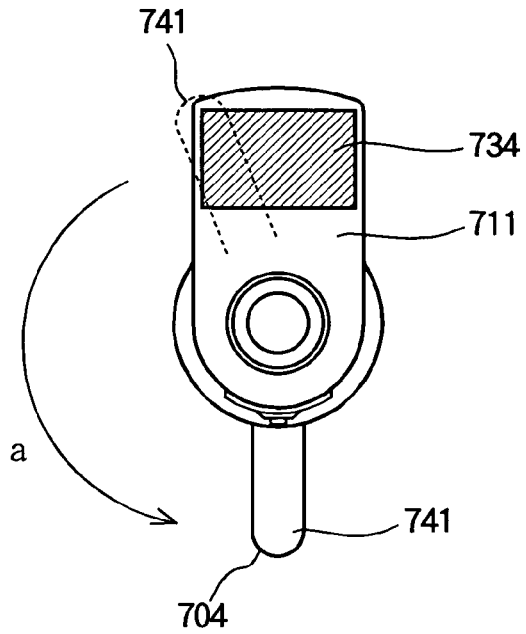
FIG. 14 is a third view for illustrating the detection operation according to the first embodiment of the present invention.

If the waste toner is not yet accumulated to a full amount (i.e., if the waste toner does not reach the height of the crank portion 741), the crank portion 741 rotates by gravity (i.e., falls) to reach the bottom position as shown in FIG. 14. As the crank portion 741 reaches the bottom position as shown in FIG. 14, the light reflection surface 730 reaches the position facing the opening 734, and reflects the light from the reflection-type sensor 760 (FIG. 4). That is, the reflection-type sensor 760 is turned to the ON-state. Since the engagement between the rotation transmission ribs 732 and 752 (FIG. 9B) is released, the crank portion 741 stays at the bottom position, and the light-reflection surface 730 stays at the position facing the opening 734 (i.e., the reflection-type sensor 760 is kept in the ON-state), while the driving gear 714 keeps rotating.

Thereafter, as the rotation transmission rib 752 (FIG. 9B) comes to engagement with the rotation transmission rib 732, the waste toner full detection bar 704 and the waste toner full detector member 711 start rotating at a constant speed together with the driving gear 714. With this rotation, the light-reflection surface 730 moves out of the position facing the opening 734, and the reflection-type sensor 760 is turned to the OFF-state.

Figure 15:
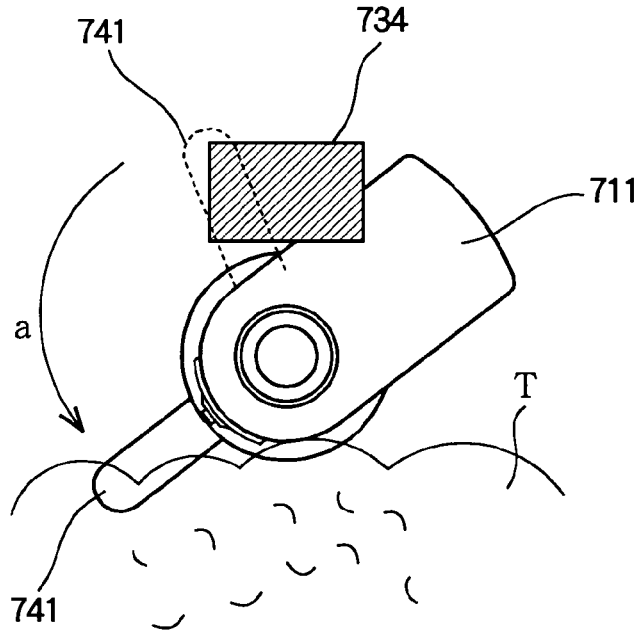
FIG. 15 is a fourth view for illustrating the detection operation according to the first embodiment of the present invention.

In contrast, if the waste toner is accumulated to a full amount (i.e., if the waste toner reaches the height of the crank portion 741) as shown in FIG. 15, the crank portion 741 rotates by gravity as shown by the arrow "a", but the rotation of the crank portion 741 is stopped due to the resistance of the accumulated waste toner. In this state, the light reflection surface 730 does not reach the position facing the opening 734, and therefore the reflection-type sensor 760 remains in the OFF-state. Thereafter, as the rotation transmission rib 752 (FIG. 9B) comes to engagement with the rotation transmission rib 732 (by the rotation of the driving gear 714), the waste toner full detection bar 704 and the waste toner full detector member 711 start rotating at a constant speed together with the driving gear 714. During this rotation, the light reflection surface 730 passes the position facing the opening 734 at the constant speed.

In this case, the light reflection surface 730 merely passes the opening 734 at the constant speed, and therefore the time interval while the light reflection surface 730 reflects the light from the reflection-type sensor 760 (i.e., while the refection-type sensor 760 is in the ON-state) is shorter than in the case where the waste toner is not accumulated to the full amount (FIG. 14). Further, a timing at which the reflection-type sensor 760 is turned to the ON-state is delayed, compared with the case where the waste toner is not accumulated in the full amount (FIG. 14).

FIGS. 16A and 16B are timing charts schematically showing the state of the reflection-type sensor 760. FIG. 16A shows the state of the reflection-type sensor 760 when the waste toner is not accumulated to the full amount. FIG. 16B shows the state of the reflection-type sensor 760 when the waste toner is accumulated to the full amount.

If the waste toner is not accumulated to the full amount, when the crank portion 741 of the waste toner full detection bar 704 reaches the top position shown in FIG. 13, the crank portion 741 (i.e., the waste toner full detection bar 704) rotates independently from the driving gear 714, and rotates by gravity (i.e., falls) from the top position to the bottom position shown in FIG. 14. At the same time, the light reflection surface 730 reaches the position facing the opening 734, and the reflection-type sensor 760 is turned to the ON-state. The reflection-type sensor 760 is kept in the ON-state until the driving gear 714 rotates to a position where the rotation transmission ribs 732 and 752 (FIG. 9B) engage each other. Then, the waste toner full detection bar 704 and the waste toner full detector member 711 start rotating together with the driving gear 714, so that the crank portion 741 moves apart from the bottom position, and the light reflection surface 730 moves apart from the position facing the opening 734 (i.e., the reflection-type sensor 760 is turned to the OFF-state). This operation is repeated as long as the waste toner is not accumulated to the full amount.

In contrast, if the waste toner is accumulated to the full amount, when the crank portion 741 rotates by gravity (i.e., falls) from the top position, the crank portion 741 stops rotating by abutting against the accumulated waste toner, and therefore the crank portion 741 does not reach the bottom position. Thereafter, the driving gear 714 rotates to a position where the rotation transmission ribs 732 and 752 (FIG. 9B) engage each other. Then, the waste toner full detection bar 704 and the waste toner full detector member 711 start rotating together with the driving gear 714, so that the crank portion 741 passes the bottom position, and the light reflection surface 730 passes the position facing the opening 734 at a constant speed. Therefore, the timing at which the reflection-type sensor 760 is turned to the ON-state is delayed, compared with the case where the waste toner is not accumulated to the full amount. The delay time is expressed by "d" in FIG. 16B. Thus, if there is the delay time "d", it is determined that the waste toner (conveyed in the second conveying space 44 in the direction shown by the arrow D) reaches the crank portion 741.

According to the first embodiment, the second conveying space 44 is provided in addition to the first conveying space 43 where the waste toner is conveyed by the waste toner conveying spiral 703. In the second conveying space 44, the waste toner is conveyed in the direction different from (more specifically, opposite to) the conveying direction by the waste toner conveying spiral 703. Further, the crank portion 741 is provided substantially in the portion where the conveying of the waste toner in the second conveying space 44 is terminated. Therefore, the waste toner can be efficiently stored in the first conveying space 43 and the second conveying space 44 of the waste toner storage space 40.

Further, the accumulation of the waste toner (i.e., the arrival of the waste toner at the crank portion 741) is detected based on the resistance of the waste toner acting on the crank portion 741 of the rotating waste toner full detection bar 704. Therefore, the accumulation of the waste toner can be detected just before the waste toner storage space 40 is filled with the waste toner. Thus, the waste toner storage space 40 can be efficiently used.

Further, the accumulation of the waste toner is detected by optically detecting the change in the rotational motion of the crank portion 741 (due to the resistance of the accumulated waste toner) when the crank portion 741 rotates by gravity, and the accumulation of the waste toner-can be precisely detected.

As described above, according to the first embodiment, the accumulation of the waste toner can be detected just before the waste toner storage space 40 is filled with the waste toner, and therefore it becomes possible to efficiently use the waste toner storage space 40. Further, the conveying of the waste toner by the waste toner conveying spiral 703 can be stopped before a torque applied to the waste toner conveying spiral 703 increases, and therefore application of large torque (load) to the waste toner conveying spiral 703 can be prevented, and a leakage of the waste toner can be prevented.

Second Embodiment

Next, the second embodiment of the present invention will be described. FIG. 17 is a sectional view showing a waste toner storage portion 32 according to the second embodiment. In the second embodiment, elements that are the same are those of the first embodiment are assigned the same reference numerals, and explanations thereof will be omitted. Further, an electrophotographic process in the second embodiment is the same as that described in the first embodiment.

As shown in FIG. 17, a waste toner conveying spiral 805 (i.e., a developer conveying unit) of the second embodiment includes a first conveying spiral 803 as a first conveying member, and a second conveying spiral 804 as a second conveying member. Unlike the waste toner conveying spiral 703 of the first embodiment, the first conveying spiral 803 of the waste toner full detection bar 805 has a conveying-terminating position F distanced from the wall surface 702*a*. More specifically, the conveying-terminating position F of the first conveying spiral 803 is substantially at a center between a position of the wall surface 702*a* of the side plate 702 (i.e., a wall surface position H) and a waste toner full detecting position E where the crank portion 741 detects the waste toner. When a distance from the wall surface position H to the waste toner full detecting position E is expressed as $L_2$, a distance from the wall surface position H to the conveying-terminating position F is substantially $L_2/2$.

Further, the first conveying spiral 803 has a blade portion that ends at the conveying-terminating position F. In other words, the first conveying spiral 803 does not extend throughout the first conveying space 43. The second conveying spiral 804 extends from the conveying-terminating position F to the wall surface 702*a* of the side plate 702. The second conveying spiral 804 has a smaller blade portion than the blade portion of the first conveying spiral 803. The blade portion of the second conveying spiral 804 is formed into a spiral shape whose winding direction is opposite to the blade portion of the first conveying spiral 803. That is, the second conveying spiral 804 generates a conveying force in a direction opposite to a conveying force generated by the first conveying spiral 803. With such a structure, a force with which the waste toner (conveyed by the first conveying spiral 803) is pressed against the wall surface 702*a* is reduced, and agglomeration of the waste toner is prevented. The second conveying spiral 804 has a rotation axis substantially coaxial with the rotation axis 803*a* of the first conveying spiral 803. Further, the second conveying spiral 804 extends continuously from the first conveying spiral 803.

When the accumulated waste toner reaches the waste toner full detecting position E, the accumulated waste toner contacts the crank portion 741 of the waste toner full detection bar 704. In this state, the accumulated waste toner provides a resistance acting on the waste toner full detection bar 704, and the rotational motion of the waste toner full detection bar 704 changes as described in the first embodiment.

The crank portion 741 has a longitudinal portion 741*a* (substantially parallel to the rotation axis of the waste toner full detection bar 704) and two inclined portions 741*b* and 741*c* formed on both sides of the longitudinal portion 741*a*. A position on the waste toner full detection bar 704 at which the straight portion 742 extends into the inclined portion 741*b* is expressed as a position G. A position at which the inclined portion 741*b* extends into the longitudinal portion 741*a* is expressed as a position I. A distance from the position G to the position I (in the axial direction of the waste toner full detection bar 704) is expressed as a distance $L_3$. The waste toner full detecting position E is defined at a distance $L_3/2$ (i.e., half of $L_3$) from the position G.

In this embodiment, the waste toner full detecting position E is defined at a distance $L_3/2$ from the position G as described above. However, it is also possible to set the waste toner full detecting position to the position G or the position I, taking into account detection accuracy or the like. Further, it is also possible that the inclined portion 741*b* (and/or the inclined portion 741*c*) extends perpendicular to the rotation axis of the waste toner full detection bar 704 (i.e., $L_3$=0 mm).

Next, a description will be made of an operation for conveying the waste toner in the waste toner storage portion 32 according to the second embodiment.

Figure 18:
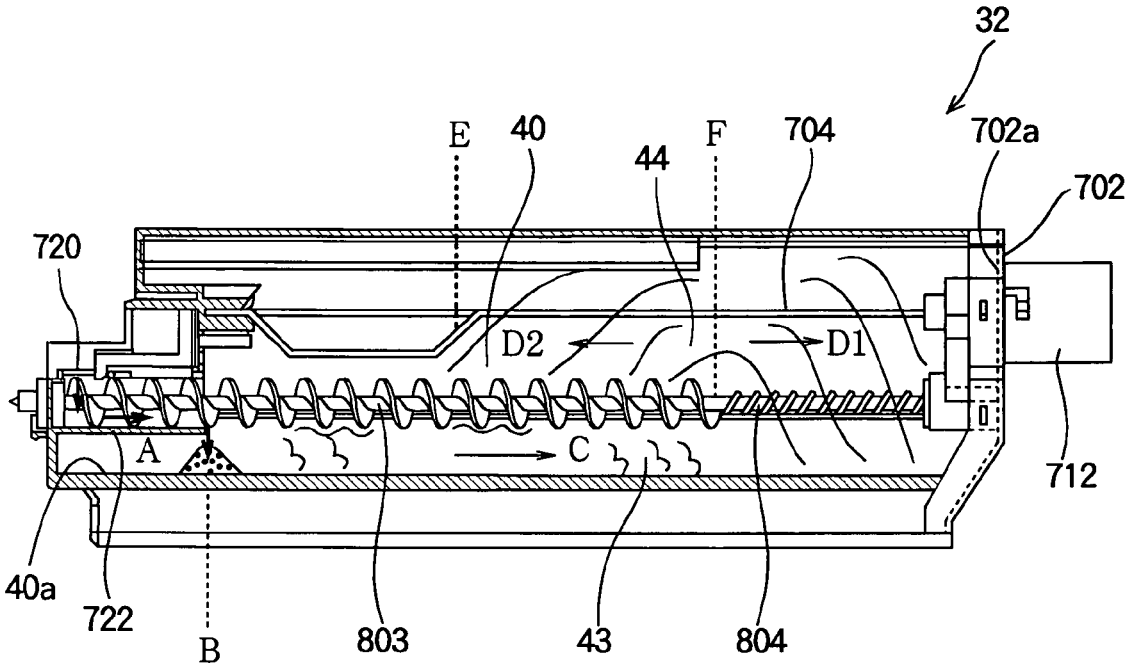
FIG. 18 is a sectional view showing a conveying operation of the waste toner in the waste toner storage portion according to the second embodiment of the present invention.

FIG. 18 is a sectional view schematically showing the operation for conveying the waste toner in the waste toner storage portion 32 according to the second embodiment. As shown in FIG. 18, the waste toner is ejected from the developing units 2*k*, 2*y*, 2*m* and 2*c* (FIG. 2), is conveyed by the second conveying unit 28 (FIG. 2), and is stored in the waste toner storage portion 32 via the waste toner receiving opening 720. The waste toner is conveyed in a direction indicated by an arrow A through the cylindrical conveying path 722 by the first conveying spiral 803 rotating about the rotation axis 803*a*. As the waste toner reaches the end of the cylindrical conveying path 722, the waste toner starts to be accumulated in a chevron shape at a position B on a bottom surface 40*a* of the waste toner storage space 40. When the accumulated waste toner reaches the height of the waste toner conveying spiral 803, the waste toner is conveyed in a direction indicated by an arrow C by the waste toner conveying spiral 803. Similarly, the waste toner accumulated at a portion on a downstream side of the position B (in the direction indicated by the arrow C) is also conveyed in the direction indicated by the arrow C by the waste toner conveying spiral 803.

As a result, the waste toner reaches the conveying-terminating position F of the first conveying spiral 830, and is accumulated in a chevron shape. The waste toner is accumulated on both sides of the conveying-terminating position F (i.e., in directions shown by arrows D1 and D2 in FIG. 18) in the second conveying space 44. A timing at which the waste toner fills a space between the conveying-terminating position F and the wall surface 702*a* (as shown by the arrow D1) is substantially the same as a timing at which the waste toner fills a space between the conveying-terminating position F and the waste toner full detecting position E (as shown by the arrow D2). The arrival of the accumulated waste toner at the waste toner full detecting position E is detected by the waste toner full detector member 711 and the reflection-type sensor 760 as described in the first embodiment.

In this regard, when the accumulated waste toner reaches the wall surface 702*a* of the side plate 702, the waste toner is gradually accumulated in the direction D2 while the waste toner is compressed in the direction D1 by the force of the first conveying spiral 803, and thereafter a torque on the waste toner conveying spiral 805 may increase. However, the accumulation of the waste toner is detected by the waste toner full detector member 711 and the reflection-type sensor 760 before the compression of the waste toner proceeds. Therefore, the accumulation of the waste toner can be detected without increasing the torque (i.e., load) on the waste toner conveying spiral 805.

In the second embodiment, as shown in FIG. 17, the wall surface 702*a* of the side plate 702 is defined as the wall surface position H, in order to maximize the amount of the waste toner stored in the waste toner storage space 40. However, the wall surface 702*a* side of the waste toner storage space 40 is indented, because the gear housing portion 724 has a first wall surface 724*a*, a second wall surface 724*b* (facing the waste toner full detection bar 704) and a third wall surface 724*c* (facing the waste toner conveying spiral 805). Therefore, it is also possible to replace the wall surface position H with a wall surface position J corresponding to the first wall surface 724*a*, a wall surface position K corresponding to the second wall surface 724*b*, or a wall surface position L corresponding to the third wall surface 724*c*, taking into account the compression of the waste toner. In other words, the conveying-terminating position F of the first conveying spiral 803 can be determined based on the wall surface position J, K or L instead of the wall surface position H.

In this embodiment, the distance $L_2$ is set to 140 mm, and the distance $L_3$ is set to 12 mm. Further, a distance KH between the wall surface position K and the wall surface position H is set to 19 mm. A distance JH between the wall surface position J and the wall surface position H is set to 14 mm. A distance LH between the wall surface position L and the wall surface position H is set to 21 mm.

It is preferable that a distance EF between the waste toner full detecting position E and the conveying-terminating position F of the first conveying spiral 803 is substantially the same as a distance FH between the conveying-terminating position F and the wall surface 702*a*. In other words, EF:FH is preferably 1:1. However, the same advantage (in preventing agglomeration of the waste toner) can be obtained when a difference between the distances EF and FH is within approximately ±30% of the distance EF.

For example, the wall surface in the direction C (i.e., the conveying direction by the first conveying spiral 803) has the wall surface positions K, J, H and L. The distance $L_2$=140 mm, the distance EF=62 mm, the distance FH=78 mm, the distance KH=19.1 mm, the distance JH=13.8 mm, and the distance LH=20.7 mm. Under these conditions, a distance FK between the conveying-terminating position F and the wall surface position K is 58.9 mm, a distance FJ between the conveying-terminating position F and the wall surface position J is 64.2 mm, and a distance FL between the conveying-terminating position F and the wall surface position L is 57.3 mm. The distances EF, FH, FK, FJ and FL satisfy the following relationship:

$$EF:FH:FK:FJ:FL=1:1.26:0.95:1.04:0.92$$

The distances FH, FK, FJ and FL are within ±30% with respect to the distance EF, and therefore are an advantage in preventing agglomeration of the waste toner can be provided.

According to the second embodiment, the second conveying space 44 is provided in addition to the first conveying space 43 where the waste toner is conveyed by the waste toner conveying spiral 805. In the second conveying space 44, the waste toner is conveyed in the direction different from (more specifically, opposite to) the conveying direction by the first conveying spiral 803. Further, the crank portion 741 is disposed substantially at the portion where the conveying of the waste toner in the second conveying space 44 is terminated. Therefore, the waste toner can be efficiently stored in the first conveying space 43 and the second conveying space 44 of the waste toner storage space 40.

Furthermore, the accumulation of the waste toner (i.e., the arrival of the waste toner at the crank portion 741) is detected based on the resistance acting on the crank portion 741, and therefore the accumulation of the waste toner can be detected just before the waste toner storage space 40 is filled with the waste toner. Thus, the waste toner storage space 40 can be efficiently used.

Further, the accumulation of the waste toner is detected by optically detecting the change in the rotational motion of the waste toner full detector member 711 (due to the resistance of the accumulated waste toner) when the waste toner full detector member 711 rotates by gravity, and therefore the accumulation of the waste toner can be precisely detected.

Furthermore, the conveying-terminating position F of the first conveying spiral 803 (i.e., the first conveying member) is defined on the downstream side of the first conveying spiral 803 and between the crank portion 741 (i.e., the developer detection unit) and the wall surface 702*a*. Therefore, it becomes possible to prevent agglomeration of the waste toner conveyed by the first conveying spiral 803 and pressed against the wall surface 702*a*.

In addition, the blade portion of the first conveying spiral 803 does not extend throughout the first conveying space 43, but ends at the conveying-terminating position F between the waste toner full detecting position E of the crank portion 741 and the wall surface 702*a*. The second conveying spiral 804 extends from the conveying-terminating position F, and has the blade portion whose conveying direction is opposite to that of the first conveying spiral 803 and whose size is smaller than that of the first conveying spiral 803. Therefore, a force with which the waste toner (conveyed by the first conveying spiral 803) is pressed against the wall surface 702*a* is reduced, with the result that the agglomeration of the waste toner is prevented.

Moreover, the conveying-terminating position F is defined at substantially the center between the wall surface 702*a* of the side plate 702 and the waste toner full detecting position E in the second conveying space 44. Therefore, the timing at which the waste toner reaches the waste toner full detecting position E is substantially the same as the timing at which the waste toner reaches the wall surface 702*a*. Thus, the accumulation of the waste toner is detected substantially at the same time as the torque (load) on the waste toner conveying spiral 805 starts to increase. Therefore, the waste toner storage space 40 can be efficiently used.

As described above, according to the second embodiment, the accumulation of the waste toner is detected substantially at the same time as the torque on the waste toner conveying spiral 805 starts to increase. Therefore, the waste toner storage space 40 can be efficiently used, while preventing the waste toner conveying spiral 805 from being applied with a large torque.

In the above described first and second embodiments, the detection of the accumulation of the waste toner is performed by detecting the rotation of the waste toner full detection bar 704 with the crank portion 741 using the reflection-type sensor 760 (the rotation detection unit). However, it is also possible to use an optical sensor or the like for detecting the waste toner reaching a certain position (for example, the waste toner full detecting position E).

Further, the reflection-type sensor 760 (FIG. 5) as the optical detection unit can be disposed on the image forming apparatus (for example, the printer 1) or can be disposed on the developer storage apparatus (for example, the waste toner storage portion 32).

Further, the present invention is applicable to a developer storage apparatus for storing a developer (for example, a fresh toner) other than a waste toner.

The first and second embodiments have been described with reference to the electrophotographic printer as an example of the image forming apparatus. However, the present invention is applicable to a copier, a facsimile, a combined machine or the like.

While the preferred embodiments of the present invention have been illustrated in detail, it should be apparent that modifications and improvements may be made without departing from the spirit and scope of the invention as described in the following claims.

What is claimed is:

1. A developer storage apparatus comprising:

a developer receiving opening for receiving a developer;

a developer conveying unit disposed below said developer receiving opening and configured to convey said developer in a conveying direction;

a developer detection unit for detecting said developer, and a wall surface portion provided on a downstream side of said developer detection unit in said conveying direction;

wherein said developer detection unit extends substantially parallel to said developer conveying unit, and is disposed at an upper position relative to said developer conveying unit.

2. The developer storage apparatus according to claim 1, wherein said developer conveying unit has a first conveying member that conveys said developer in said conveying direction and a second conveying member, and wherein said first conveying member has an end disposed between said developer detection unit and said wall surface portion.

3. The developer storage apparatus according to claim 2, wherein said developer detection unit has a developer detecting position, and wherein said end of said first conveying member is substantially at a center between said developer detecting position and said wall surface portion.

4. The developer storage apparatus according to claim 2, wherein said second conveying member is configured to generate a conveying force in a direction opposite to that of said first conveying member.

5. The developer storage apparatus according to claim 2, wherein said second conveying member is configured to generate a smaller conveying force than said first conveying member.

6. The developer storage apparatus according to claim 2, wherein said first conveying member and said second conveying member are constituted by conveying spirals which are coaxial with each other.

7. The developer storage apparatus according to claim 1, wherein said developer detection unit has a shorter length than said developer conveying unit in a longitudinal direction of said developer storage apparatus, and wherein said developer detection unit is disposed on said developer receiving opening side.

8. The developer storage apparatus according to claim 1, wherein said developer detection unit has a crank portion, and a detection of said developer is performed by detecting a rotational motion of said crank portion.

9. The developer storage apparatus according to claim 8, wherein said detection of said developer is performed by an optical detection unit, and wherein said optical detection unit optically detects a change in a rotational motion of said crank portion due to a resistance of said developer accumulated in said developer storage apparatus, when said crank portion rotates by gravity due to a weight of said crank portion.

10. A developer cartridge comprising said developer storage apparatus according to claim 1.

11. The developer cartridge according to claim 10, further comprising a developer storage portion that stores a black developer, wherein said developer storage apparatus and said developer storage portion are provided integrally with each other.

12. A developing device comprising said developer storage apparatus according to claim 1.

13. A developing device comprising said developer cartridge according to claim 10.

14. An image forming apparatus comprising said developer storage apparatus according to claim 1.

15. A developer storage apparatus comprising:

a developer receiving opening for receiving a developer;

a developer conveying unit disposed below said developer receiving opening and configured to convey said developer in a conveying direction;

a rotation member juxtaposed to said developer conveying unit, said rotation member having a crank portion, and a wall surface portion provided on a downstream side of said crank portion in said conveying direction;

wherein said rotation member extends substantially parallel to said developer conveying unit, and is disposed at an upper position relative to said developer conveying unit.

16. A developer cartridge comprising said developer storage apparatus according to claim 15.

17. The developer cartridge according to claim 16, further comprising a developer storage portion that stores a black developer, wherein said developer storage apparatus and said developer storage portion are provided integrally with each other.

18. A developing device comprising said developer storage apparatus according to claim 15.

19. A developing device comprising said developer cartridge according to claim 16.

20. An image forming apparatus comprising said developer storage apparatus according to claim 15.

21. The developer storage apparatus according to claim 1, further comprising a cylindrical portion that receives said developer supplied via said developer receiving opening, wherein said cylindrical portion is formed so as to cover a part of said developer conveying unit, and wherein said developer detection unit has a detecting portion corresponding to a region where said developer conveying unit is not covered by said cylindrical portion.

22. The developer storage apparatus according to claim 21, wherein said developer conveying unit has a first conveying unit, and a second conveying unit having a smaller conveying force than that of said first conveying unit, wherein said developer detection unit has a crank portion, and wherein said crank portion is provided above said first conveying unit.

23. The developer storage apparatus according to claim 1, wherein, with respect to said developer conveying unit, said developer detection unit is located in a direction in which said developer conveyed by said developer conveying unit is accumulated.

24. The developer storage apparatus according to claim 15, further comprising a cylindrical portion that receives said developer supplied via said developer receiving opening, wherein said cylindrical portion is formed so as to cover a part of said developer conveying unit, and wherein said crank portion is disposed corresponding to a region where said developer conveying unit is not covered by said cylindrical portion.

25. The developer storage apparatus according to claim 24, wherein said developer conveying unit has a first conveying unit, and a second conveying unit having a smaller conveying force than that of said first conveying unit, wherein said crank portion is provided above said first conveying unit.

26. The developer storage apparatus according to claim 15, wherein, with respect to said developer conveying unit, said rotation member is located in a direction in which said developer conveyed by said developer conveying unit is accumulated.

* * * * *